US006490427B2

(12) United States Patent
Shields

(10) Patent No.: US 6,490,427 B2
(45) Date of Patent: Dec. 3, 2002

(54) STATIONARY TONER DELIVERY DEVICE WITH CLOCK PULSES

(75) Inventor: Bruce M. Shields, Chatsworth, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/734,621

(22) Filed: Dec. 11, 2000

(65) Prior Publication Data

US 2002/0071696 A1 Jun. 13, 2002

(51) Int. Cl.[7] ..... G03G 15/00

(52) U.S. Cl. ..... 399/252

(58) Field of Search ..... 399/352

(56) References Cited

U.S. PATENT DOCUMENTS 4,775,868 A * 10/1988 Sugiura ..... 346/46
5,206,667 A * 4/1993 Yano ..... 347/55
5,717,986 A * 2/1998 Vo et al. ..... 399/291

FOREIGN PATENT DOCUMENTS

JP 5-127518 * 5/1993
JP 2000211178 * 8/2000

* cited by examiner

*Primary Examiner*—Quana M. Grainger
(74) *Attorney, Agent, or Firm*—Philip T. Virga

(57) ABSTRACT

A stationary device for transporting charged toner. The device is constructed from alternate conductive and insulative layers, with all layers having a central hole to form a tube when laminated. The conductive layers, numbered modulo n, are connected to a number n of phased clocks so that appropriately charged toner will proceed down the length of the tube.

3 Claims, 2 Drawing Sheets

STATIONARY TONER DELIVERY DEVICE WITH CLOCK PULSES

BACKGROUND OF THE INVENTION

Apparatus for transporting a dry toner powder cloud in a xerographic printer which uses a tube having walls composed of a grid of phased voltage elements to transport the charged powder particles.

Some xerographic printers use dry toner particles which can be transported from a sump to a target location, such as a charged photoreceptor, by the use of a stationary insulative substrate having a series of imbedded conductive elements in its surface to form a grid. A voltage is applied to the- toner, and phased voltages are applied to the conductive elements, resulting in a toner cloud being transported along the stationary grid. Such a device is described in U.S. Pat. No. 5,717,986 and U.S. patent application Ser. No. 09/613,018, which are incorporated by reference herein.

Most of the toner is reliably carried in this way, but the cloud is subject to local air turbulence, and to a weakened or variable voltage at the edge of the grid, resulting in toner loss or non-uniform transport speed. The edge effect can be minimized by increasing the width of the grid, but at the cost of increasing size and space requirements. A more compact and reliable form would be useful.

SUMMARY OF THE INVENTION

An improvement would be to build a laminated structure of alternating layers of insulation and conductors to form a phased array of conductive elements. A hole could then be bored through the laminations to form a tube, through which the toner could be transported. The tube could be of any length and diameter. This arrangement would have several advantages:

Manufacturing costs would be reduced. The diameter of the tube could be reduced to a fraction of an inch without any loss of toner and with no edge problems. Also, the resultant tube could be bent after manufacture to conform to any space/angle requirements that may exist in the printer.

In the alternative, the holes could be formed in the conducting and insulating layers before they are laminated. In this case the internal space could be any shape such as an elongated slot, so that the toner would be ejected at the end of the tube in the form of a sheet instead of a cylinder.

DETAILED DESCRIPTION OF THE INVENTION

Figure 1:
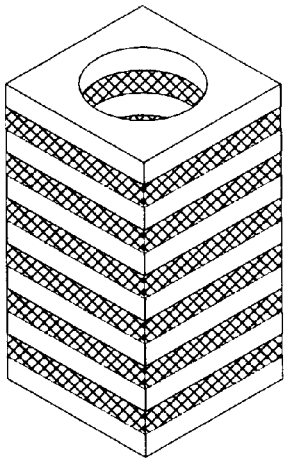
FIG. 1 shows a stack of insulative and conductive layers with a hole drilled to expose an interior grid.

FIG. 1 shows a tube having a cylindrical hole bored in a stack of alternating insulative and conductive layers, such as copper and Mylar. The copper layers could have protruding tabs for electrical connection. For example, the first and fifth could have tabs in front, the second and sixth could have tabs of the right side, etc, to make the connections simpler. A problem is that if the central hole is simply drilled, burrs inside the structure may result in an uneven border between layers, and may even result in shorting of adjacent conductive layers.

Figure 5:
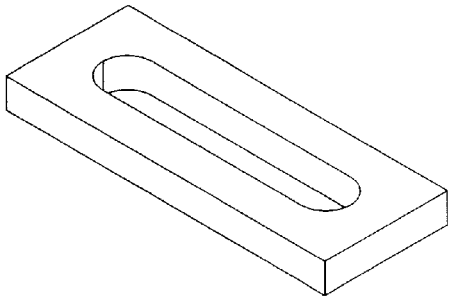
FIG. 5 illustrates how the layers could be cut before laminating.

An alternative is to cut the internal openings into the layers first, as shown in FIG. 5, before laminating. A laser cutter or the like could be used to make an opening of any size or shape without the possibility of burrs.

Figure 2:
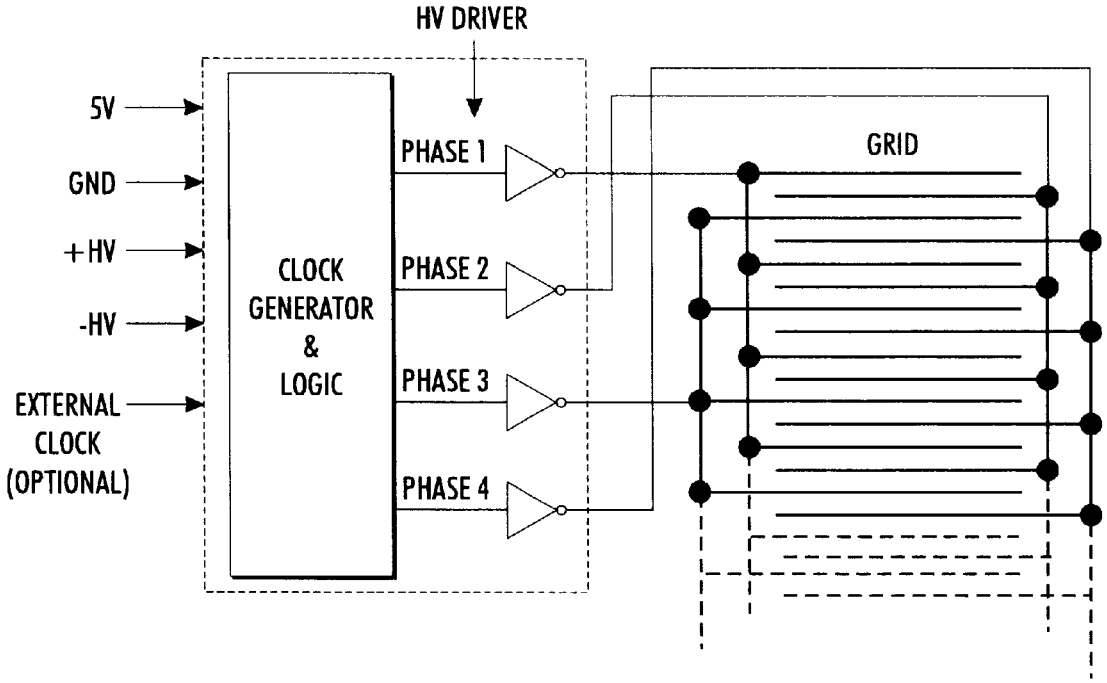
FIG. 2 is a schematic diagram showing how the four phases are connected to the grid.

The circuit for driving the grid elements is shown in FIG. 2. A clock generator receives a clock and power from the system and produces phased clocks. Any number of phases can be used, four are shown here. A typical voltage for the pulses would be four hundred volts, and the internal hole diameter can be as small as an eighth of an inch, possibly less. Each phase is connected to its set of conductive elements of the grid, as shown, the thickness of each layer being 3 mils in one embodiment. The disclosed pulse driver can generate pulses up to 1200 volts, and the logic and clock generator were integrated into a single integrated circuit.

Figure 3:
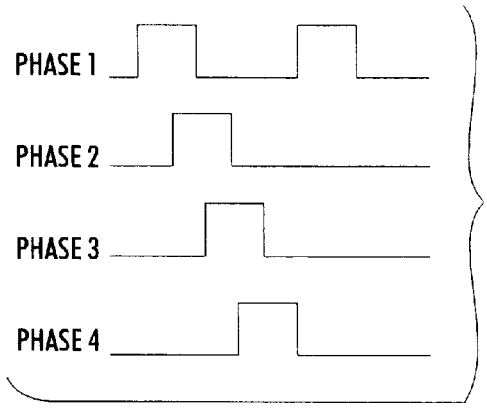
FIG. 3 is a timing diagram showing the overlapping phased waveforms.

In FIG. 3, the phases are essentially overlapping clock pulses. For the purpose of this explanation, it will be assumed that the toner is charged negatively and is attracted to a grid that is charged positively, the center of each positive phased pulse lines up in time with the leading edge of the next phase, and the negative part of the wave shape is longer than the positive part.

Figure 4:
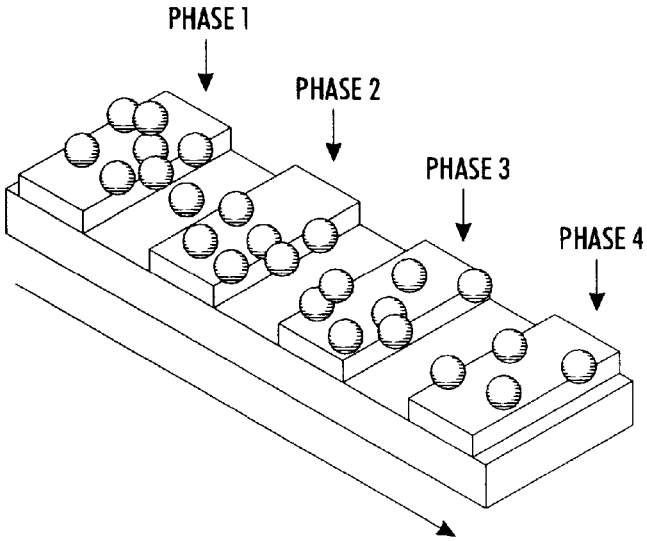
FIG. 4 shows the direction of the powder cloud in relation to the grid.

The result of this phased clock being applied to the grid is shown in FIG. 4. Any toner that was located over the phase 1 element when that element was high will move to the phase 2 element when the phase 2 element goes high and then the phase 1 element goes low. The result is a series of toner clouds, one for every four elements that proceed along the stationary grid, the speed being a function of the spacing of the grid elements and the frequency of the clocks.

If the grid layers are composed of a flexible material the device can be bent to meet location requirements inside the printer. Also, if the hole is elongated in one dimension, as shown in FIG. 5, the toner can be delivered at the output of the tube in the form of a sheet instead of a cylindrical flow. Another version is a tube that has one size or shape of hole at one end of the tube, and gradually changes to a different size or shape at the other end.

While the invention has been described with reference to a specific embodiment, it will be understood by those skilled in the art that various changes may be made and equivalents may be substituted for elements thereof without departing from the true spit and scope of the invention. In addition, many modifications may be made without departing from the essential teachings of the invention.

What is claimed is:

1. A stationary toner delivery device using clock pulses comprising:

alternate layers of conductive and insulative material, each having an internal hole in the material completely surrounded by remaining material, laminated to form a tube, the conductive layers numbered modulo n, and a source of n phased clock pulses, each phase coupled to the same numbered conductive layers wherein the phased clock pulses are overlapping in time.

2. The device of claim 1 wherein the conductive or insulative layers are made from flexible material so that the tube may be bent.

3. The device of claim 1 wherein the internal hole in the material changes its shape or size along the length of the device.

* * * * *